US010041238B2

(12) United States Patent
Daciw

(10) Patent No.: US 10,041,238 B2
(45) Date of Patent: Aug. 7, 2018

(54) PLUNGER

(75) Inventor: Michael James Daciw, Aston, PA (US)

(73) Assignee: Brasscraft Manufacturing Company, Novi, MI (US)

( * ) Notice: Subject to any disclaimer, the term of this patent is extended or adjusted under 35 U.S.C. 154(b) by 834 days.

(21) Appl. No.: 13/562,455

(22) Filed: Jul. 31, 2012

(65) Prior Publication Data

US 2014/0033419 A1 Feb. 6, 2014

(51) Int. Cl.
*E03C 1/308* (2006.01)
*E03D 9/00* (2006.01)

(52) U.S. Cl.
CPC ..... *E03C 1/308* (2013.01); *E03D 9/00* (2013.01)

(58) Field of Classification Search
CPC ..... E03D 11/00; E03D 11/02; E03D 11/14; E03D 11/16; E03D 9/007; E03C 1/308; E03C 1/302; E03C 1/304; E03C 1/30; E03C 1/12; E03C 1/306; E03C 2201/45; E03C 1/264; E03C 1/32; A47K 17/00; A47K 11/10; A47K 1/05
USPC ... 4/255.01, 255.05, 255.07, 255.08–255.11, 4/255.02–255.04, 255.06, 255.12
See application file for complete search history.

(56) References Cited

U.S. PATENT DOCUMENTS

| | | | | |
|---|---|---|---|---|
| 70,087 | A * | 10/1867 | Hadfield | A61M 1/08 4/255.01 |
| 915,687 | A * | 3/1909 | Lowe et al. | 4/255.11 |
| 2,597,336 | A | 5/1952 | Kemper | |
| 3,021,532 | A * | 2/1962 | Gross | 4/255.11 |
| 3,683,922 | A * | 8/1972 | Cutter | 604/314 |
| 5,155,877 | A | 10/1992 | Reed | |
| 6,192,525 | B1 | 2/2001 | Tash | |
| 6,216,283 | B1 | 4/2001 | Tash | |
| 6,510,860 | B2 * | 1/2003 | Kihs | 134/166 C |
| 8,307,468 | B2 * | 11/2012 | Stein | E03C 1/308 4/255.11 |
| 8,544,122 | B2 * | 10/2013 | Slot | 4/255.05 |
| 8,782,822 | B1 * | 7/2014 | Vandenbergh | 4/255.01 |
| 2008/0134421 | A1 * | 6/2008 | Sheffield et al. | 4/255.11 |
| 2010/0132102 | A1 * | 6/2010 | Flamand | 4/255.11 |
| 2010/0313345 | A1 * | 12/2010 | Stein | 4/255.11 |

OTHER PUBLICATIONS http://www.drillspot.com/products/904971/impact_products_inc_9200_industrial_oval_plunger, "Industrial Oval Plunger, Pack of 2", Apr. 14, 2011, 1 page.
http://www.sugarcraft.com/catalog/gumpaste/OP517.jpg, Apr. 14, 2011, 1 page.

(Continued)

*Primary Examiner* — Tuan N Nguyen
*Assistant Examiner* — William R Klotz
(74) *Attorney, Agent, or Firm* — Lora Graentzdoerffer; Kirk Rudolph; Brooks Kushman P.C.

(57) ABSTRACT

A plunger is provided with a flange having a length, a width and a thickness. The length is greater than the width to cover an elongated toilet trapway. A peripheral seal extends away from the flange to seal with the elongated toilet trapway. A plunger adapter is provided with a flange having a length, a width and a thickness. The length is greater than the width to cover an elongated toilet trapway. A peripheral seal extends away from the flange to seal with an elongated toilet trapway. A cylindrical receptacle is formed into the flange and spaced apart from the seal for cooperation with a radially symmetrical plunger.

16 Claims, 6 Drawing Sheets

(56) References Cited

OTHER PUBLICATIONS http://www.taartendecoratie.nl/plunger-cutters/2650-metal-oval-plunger-set-set-van-5.html, "Metal Oval Plunger Set (Set Van 5)", Apr. 14, 2011, 1 page.
http://www.polymerclayexpress.com/images/pcso.jpg, "Klay Kutters Oval Set", Apr. 14, 2011, 1 page.
http://www.polymerclayexpress.com/cutters2.html, "Polymer Clay Express", Apr. 14, 2011, 2 pages.
http://www.wasserstrom.com/restaurant-supplies-equipnnent/Product_134222?utm_source=goog . . . , "OXO International Good Grips Toilet Plunger and Canister Set", Apr. 14, 2011, 2 pages.
http://www.wasserstrom.com/restaurant-supplies-equipment/Scene7View?langld=-1&storeld=1 . . . , Apr. 14, 2011, 1 page.

* cited by examiner

PLUNGER

TECHNICAL FIELD

Various embodiments relate to a plunger for unclogging plumbing.

BACKGROUND

Conventional household toilets with a capacity in a range of 1.6 to 3.5 gallons per flush (GPF) typically employ a round or radially symmetrical trapway. Some states have mandated that toilets with a 1.28 GPF capacity are sold in an effort to conserve water. In response to the legislation, toilet manufacturers have offered high efficiency toilets with a 1.28 GPF capacity.

Many 1.28 GPF capacity toilets have elongated trapways to provide compliant toilets while still providing acceptable flushing and bowl cleaning capabilities. The elongated trapways permit powerful flushing action, despite low water volume.

SUMMARY

According to at least one embodiment, a plunger is provided with a flange having a length, a width and a thickness. The length is greater than the width to cover an elongated toilet trapway. A peripheral seal extends away from the flange to seal with the elongated toilet trapway.

According to a further embodiment, the seal extends centrally inward.

According to another further embodiment, the flange is shaped as a pair of semi-circles each having a radius that is half of a width of the flange. The semi-circles are spaced apart in a direction of the length of the flange.

According to another further embodiment, the flange has a pair of parallel sides spaced apart in a direction of the width of the flange.

According to another further embodiment, the seal is tapered inward away from the flange.

According to another further embodiment, the seal extends from a periphery of the flange.

According to another further embodiment, a cylindrical receptacle is formed into the flange and spaced apart from the seal for cooperation with a radially symmetrical plunger.

According to another further embodiment, the receptacle includes a peripheral ring extending from the flange with an aperture formed therein.

According to another further embodiment, each of a plurality of structural ribs is oriented upon the flange and extends to an intersection of the flange and the peripheral ring.

According to another further embodiment, the seal has an opening therein facing away from the flange.

According to another further embodiment, a cavity is provided within the flange and the seal for fluid communication through the flange, the seal and the seal opening.

According to another further embodiment, a bell extends from the flange and is spaced apart from the seal so that manual compression of the bell forces fluid from the bell, through the flange and the seal.

According to another further embodiment, the bell is formed from an elastomeric material whereby upon release of the manual compression, the bell extends to an unloaded position thereby forcing fluid into the seal opening, through the seal and flange, and into the bell.

According to another further embodiment, the bell is generally dome-shaped.

According to another further embodiment, a receptacle is oriented upon the bell to receive a handle.

According to another further embodiment, a handle extends from the bell.

According to another further embodiment, each of a plurality of structural ribs is oriented upon the flange and extends to an intersection of the flange and the bell.

According to at least another embodiment, a plunger is provided with a flange that is symmetrical along a plane that is generally perpendicular to the flange. The flange is radially asymmetrical to cover an elongated toilet trapway. A seal extends from the flange that is symmetrical along the plane that is generally perpendicular to the flange, the seal being radially asymmetrical to seal with the elongated toilet trapway.

According to at least another embodiment, a plunger adapter is provided with a flange having a length, a width and a thickness. The length is greater than the width to cover an elongated toilet trapway. A peripheral seal extends away from the flange to seal with an elongated toilet trapway. A cylindrical receptacle is formed into the flange and is spaced apart from the seal for cooperation with a radially symmetrical plunger.

According to a further embodiment, a plunger assembly is provided with a radially symmetrical plunger and the plunger adapter.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

As discussed above, the elongated trapways of 1.28 GPF capacity toilets are useful for flushing with reduced capacity. However, the elongated trapways may be difficult to create an adequate seal with a conventional force cup plunger or a bellows style plunger for plunging a clog in a 1.28 GPF capacity toilet. Conventional plungers employ a round or radially symmetrical seal, which is difficult to maintain contact with an asymmetrical trapway. Failure of a sealed engagement can result in reduced plunging pressure. Failure of a sealed engagement can also reduce or prevent vacuum during upstroke, wherein vacuum can be effective for loosening clogs. Seal failure can also generate a splash during a plunging operation, which may be undesirable to the user.

Figure 1:
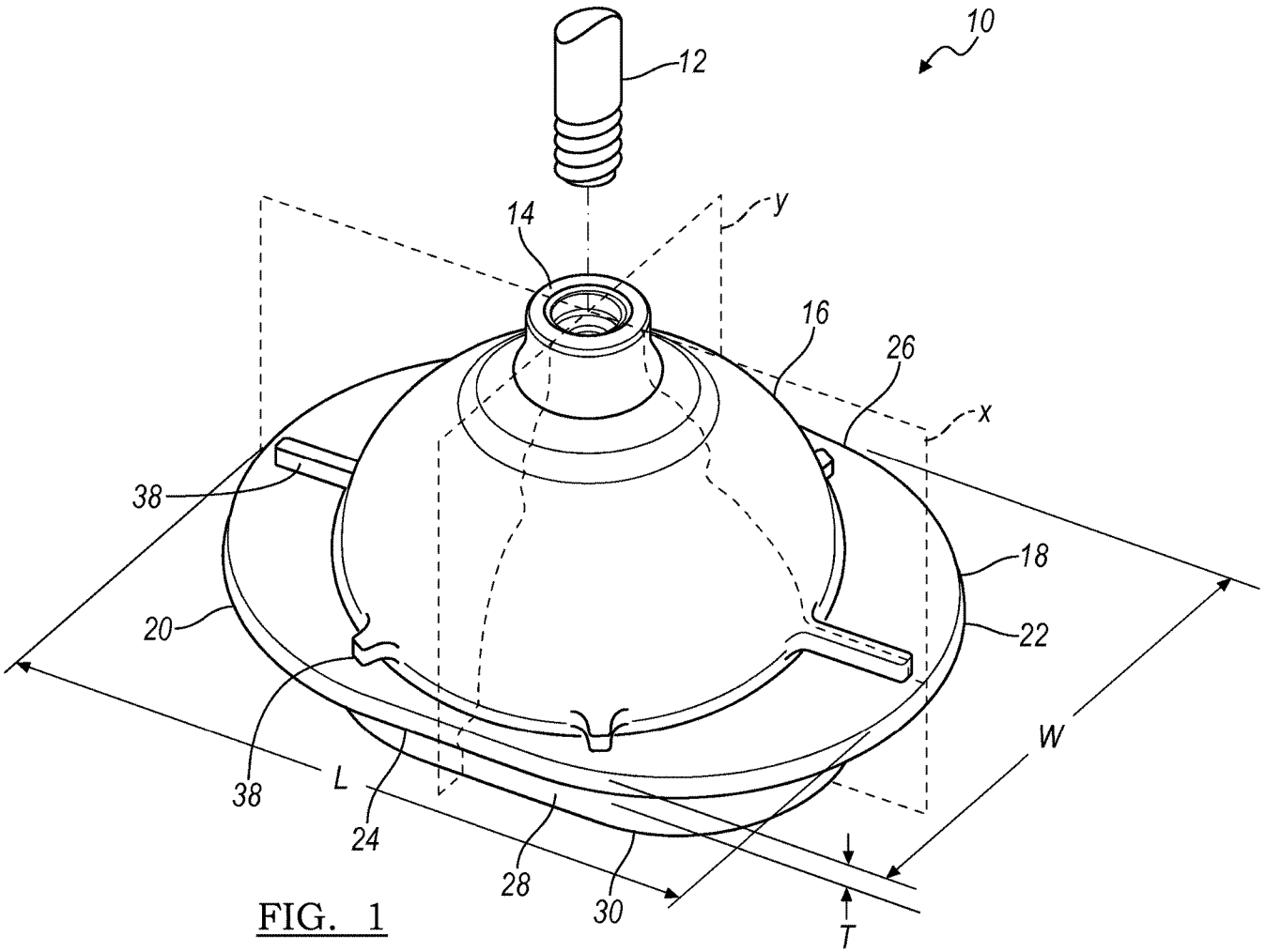
FIG. 1 is a top perspective view of a plunger according to an embodiment.

Referring now to FIG. 1, a plunger is illustrated according to an embodiment, and referenced generally by numeral 10. The plunger 10 is illustrated disassembled from a handle 12. The handle 12 is threaded and is received in a threaded receptacle 14 of the plunger 10. The plunger 10 is illustrated as what is often referred to as a force cup plunger 10. The plunger 10 includes a bell 16, which is generally dome-shaped or hemispherical in the depicted embodiment. The bell 16 may also be referred to as a force cup. The receptacle 14 is provided on top of the bell 16 for attachment of the handle 12.

A flange 18 extends about a periphery of the bell 16. The flange 18 is elongated to match an elongated trapway profile. Accordingly, the flange 18 has a length L, a width W and a thickness T; and the length L is greater than the width W to provide an elongated footprint or plan. The flange 18 may have various shapes. The depicted flange 18 is formed from a pair of semi-circles 20, 22 each having a radius that is half of the width W of the flange 18. The semi-circles 20, 22 are spaced apart in a direction of the length L of the flange 18. The flange 18 is also depicted with a pair of parallel sides 24, 26 that are spaced apart in a direction of the width W of the flange 18. Of course, various elongated flange profiles are contemplated for engagement with the elongated trapway.

For manufacturing purposes, the flange 18 may be symmetrical along a central plane x that is generally perpendicular to the flange 18. The flange 18 may also be symmetrical along another central plane y that is also generally perpendicular to the flange 18 and perpendicular to plane x. The flange 18 moreover is radially asymmetrical in order to be elongate and to cover an elongated toilet trapway.

With reference now to FIGS. 1-4, a peripheral seal 28 extends from the flange 18 facing away from the bell 16 to seal with the elongated toilet trapway. The seal 28 has a continuous profile extending from the periphery of the flange 18 and consequently is also elongated for mating receipt within the elongated trapway. The seal 28 extends centrally inward. In the depicted embodiment, the seal 28 is radially tapered so that a distal rim 30 of the seal 28 extends into the trapway and the seal 28 engages the trapway with an area contact about the periphery for maintaining a seal during the plunging operation. The seal 28 may also be symmetrical along planes x and y, radially asymmetrical to seal with the elongated toilet trapway.

The plunger 10 has an opening 32 within the rim 30 for revealing a cavity 34 within the plunger 10. The cavity 34 extends within the seal 28, the flange 18 and the bell 16 for fluid communication from the bell 16, through the flange 18, the seal 28 and the seal opening 32. The plunger 10 is formed from an elastomeric material to provide flexibility to the seal 28 for mating with the trapway, and to provide flexibility to the bell 16.

Figure 2:
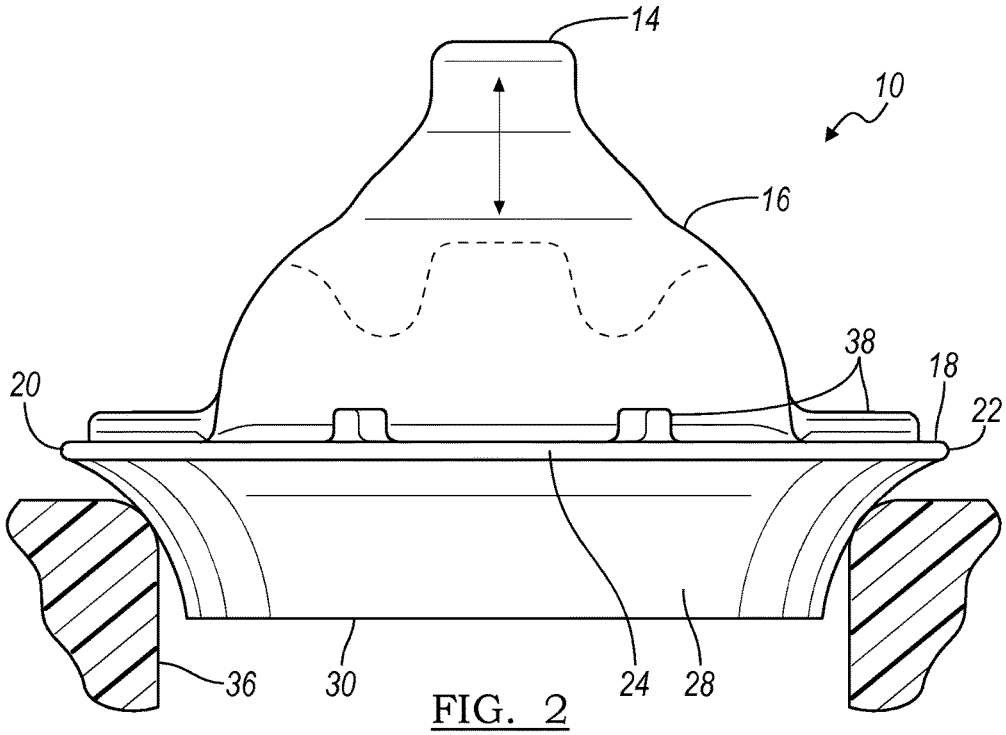
FIG. 2 is a side elevation view of the plunger of FIG. 1.
Figure 3:
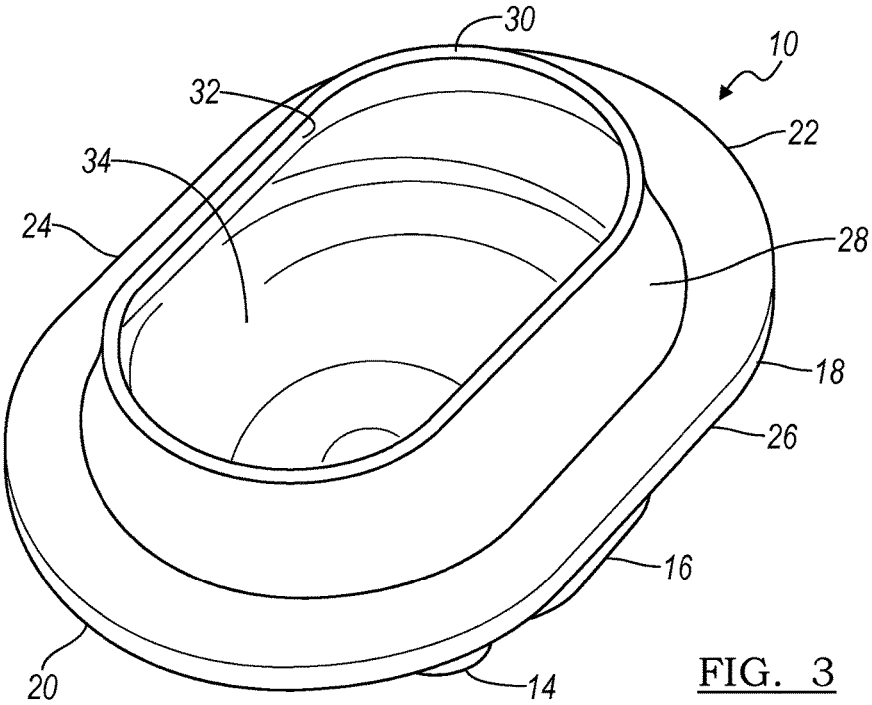
FIG. 3 is a bottom perspective view of the plunger of FIG. 1.
Figure 4:
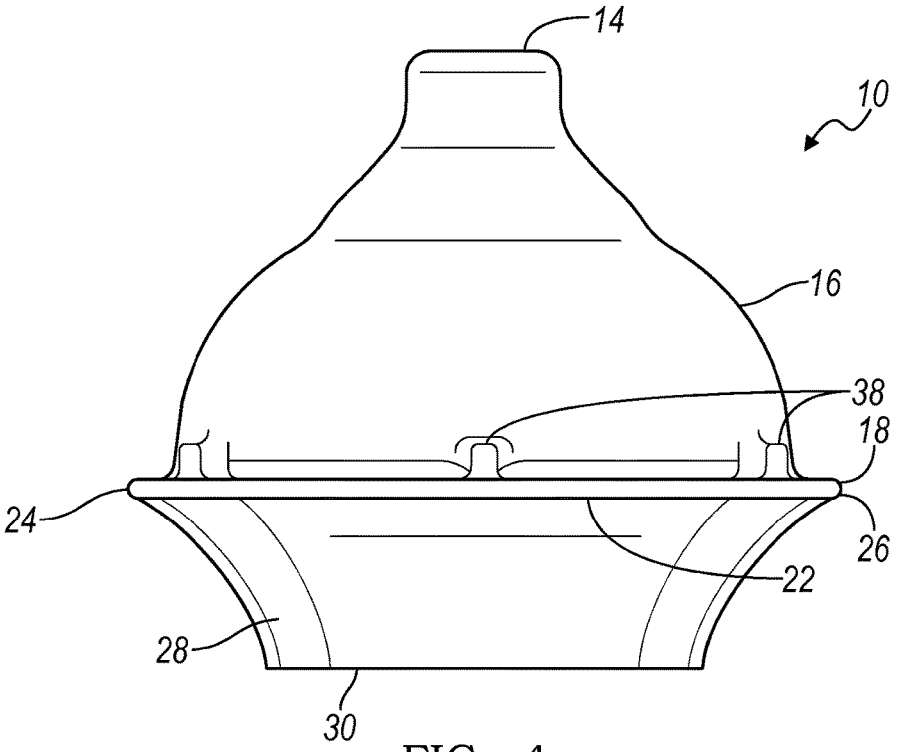
FIG. 4 is a front elevation view of the plunger of FIG. 1.

Referring now to FIG. 2, a downward force upon the handle 12 compresses the bell 16 by translating the receptacle 14 relative to the flange 18. The volume of the cavity 34 is reduced thereby forcing water, an incompressible fluid, from the cavity 34 in the bell 16, through the flange 18, the seal 28, and out of the opening 32. With a uniform mating seal provided by the tapered exterior of the seal 28 within an elongated toilet trapway 36, the water is forced into the trapway 36 thereby forcing upon a clog.

The plunger 10 has a uniform wall thickness that is sufficiently resilient such that when the plunger 10 is unloaded, the plunger 10 returns to the extended position, thereby expanding the volume of the cavity 34, generating a vacuum which pulls fluid into the cavity 34. The fluid vacuum upon the clog may also be effective in loosening or breaking the clog.

The plunger 10 may be provided with a plurality of structural ribs 38 that are oriented upon the flange 18 and extend to an intersection of the flange 18 and the bell 16 for maintaining the relative positioning of the bell 16 and the flange 18 such that bell 16 primarily deforms under the compression so that the flange 18 and the seal 28 maintain the sealed engagement during the plumbing operation.

Although discussed in the context of 1.28 GPF capacity toilets, the plunger 10 is effective for various capacity toilets with elongated trapways. Due to the flexibility of the seal 28, the seal 28 can be inserted into a radially symmetrical trapway for plunging a conventional toilet. Thus, the plunger 10 is effective for plunging conventional and modern toilets.

Figure 5:
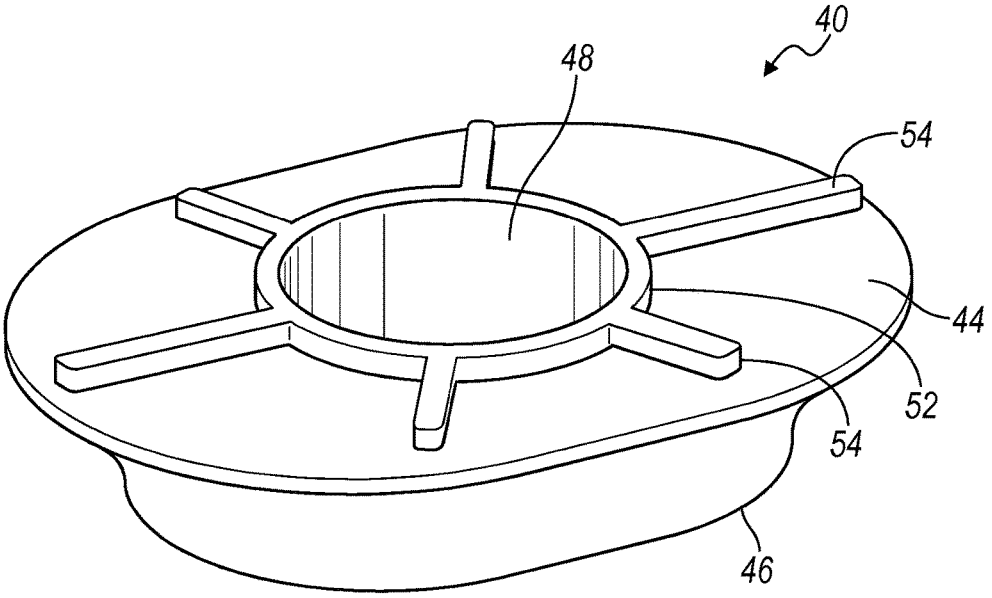
FIG. 5 is a top perspective view of a plunger adaptor according to another embodiment.
Figure 6:
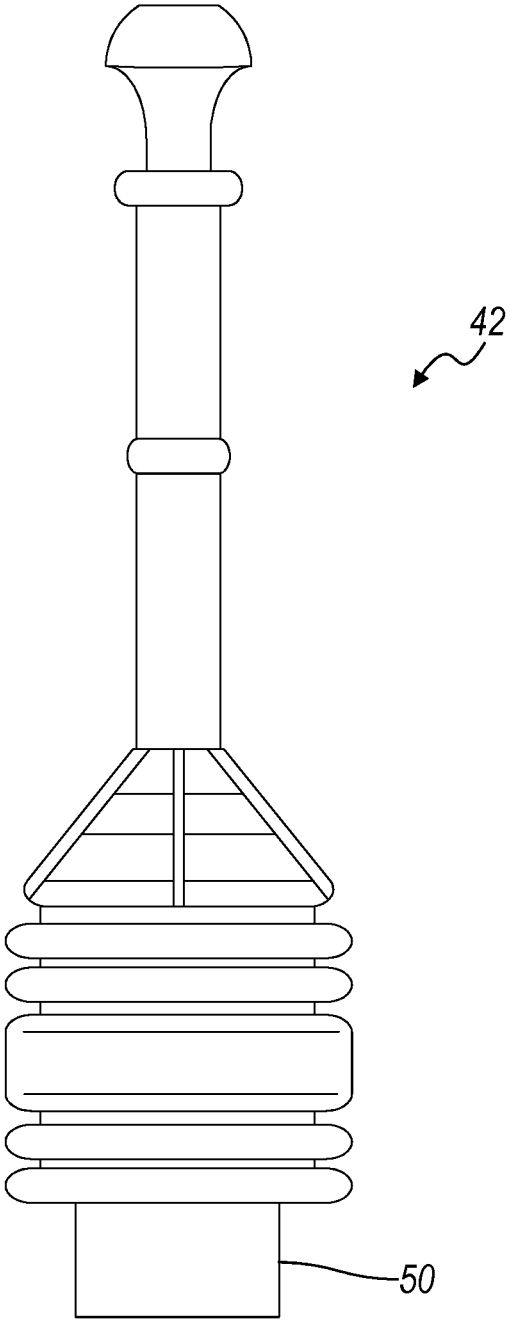
FIG. 6 is a side perspective view of a plunger for assembly to the plunger adapter of FIG. 5.

A plunger 40 is illustrated in FIG. 5 according to another embodiment. Moreover, the plunger 40 is a plunger adapter for use with conventional radially symmetrical plungers, such as a bellows plunger 42 illustrated in FIG. 6. Referring again to FIG. 5, the plunger adapter 40 has a flange 44 and a seal 46 structurally similar to the flange 18 and the seal 28 of the prior embodiment. A cylindrical receptacle 48 is provided centrally within the flange 44, and is spaced apart from the seal 46 for receiving a seal 50 (FIG. 6) of the radially symmetrical plunger 42. The receptacle 48 includes a peripheral ring 52 extending from the flange 44. A plurality of structural ribs 54 are each oriented upon the flange 44. The ribs 54 extend to an intersection of the flange 44 and the peripheral ring 52 for structural reinforcement of the flange 44 and the receptacle 48.

The seal 50 (FIG. 6) of the radially symmetrical plunger 42 is inserted into the receptacle 48 (FIG. 5) of the plunger adapter 40. The plunger 42 provides the plunging operation, while the adapter 40 provides a fluid-tight seal 46 between the plunger 42 and the trapway. Thus, the plunger adapter 40 may be employed for converting a conventional plunger 42 into a plunger assembly 40, 42 for plunging an elongated trapway.

Figure 7:
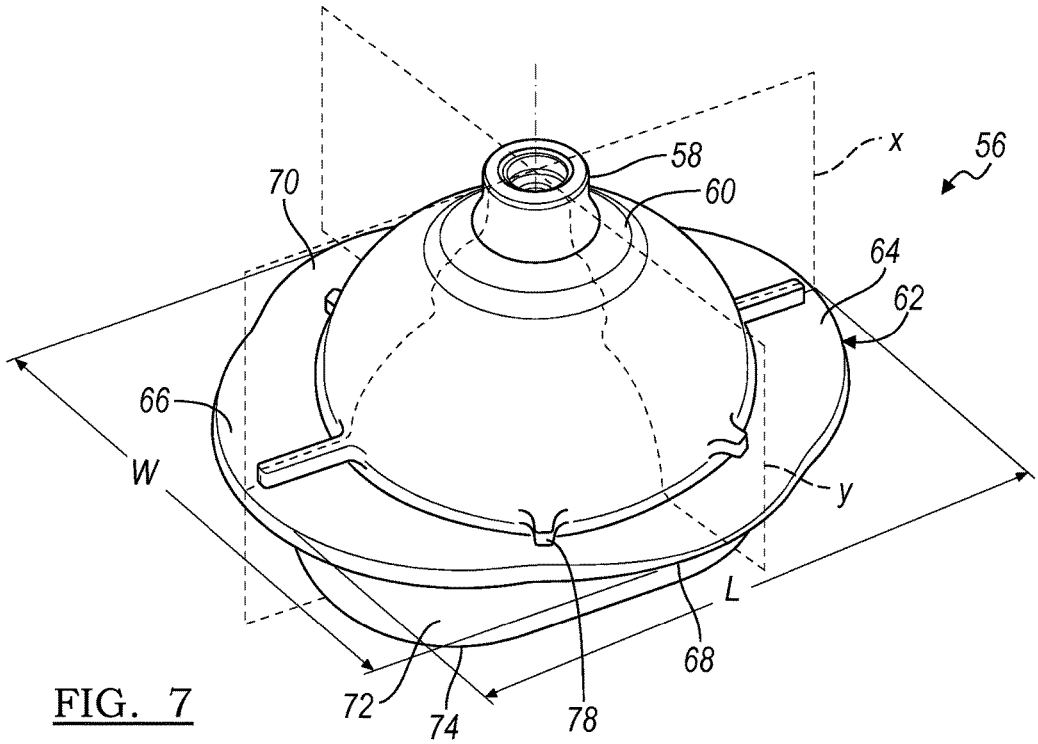
FIG. 7 is a top perspective view of a plunger according to another embodiment.
Figure 8:
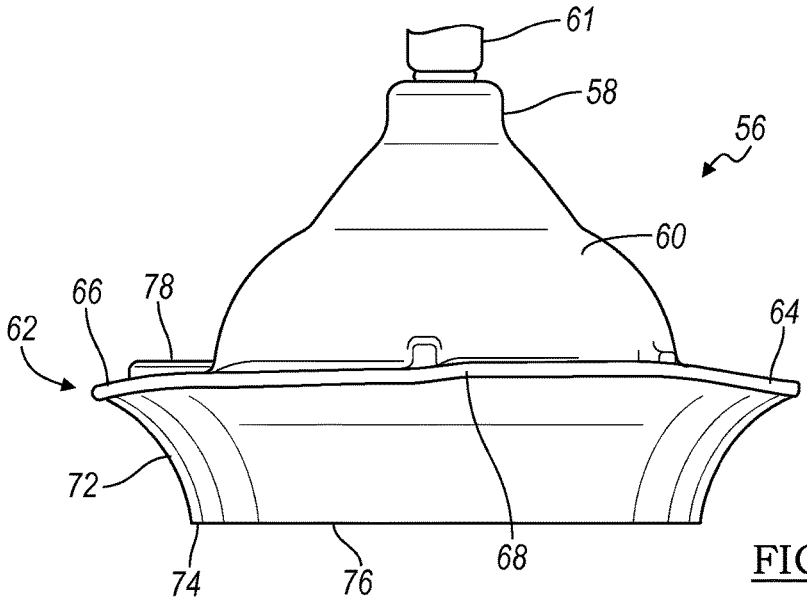
FIG. 8 is a side perspective view of the plunger of FIG. 7.

Referring now to FIGS. 7 and 8, a plunger 56 is illustrated according to another embodiment. The plunger 56 includes a threaded receptacle 58 provided atop a bell 60 for receiving a handle 61 (FIG. 8). A flange 62 extends about a periphery of the bell 60. The flange 62 has a length L, a width W and a thickness T; and the length L is greater than the width W to provide an elongated footprint or plan. The depicted flange 62 is formed from two pairs of semi-circles 64, 66, 68, 70. One pair of semi-circles 64, 66 is spaced apart in a direction of the length L of the flange 62. The other pair of semi-circles 68, 70 is spaced apart in a direction of the width W of the flange 62.

For manufacturing purposes, the flange 62 may be symmetrical along a central plane x that is generally perpendicular to the flange 62. The flange 62 may also be symmetrical along another central plane y that is also generally perpendicular to the flange 62 and perpendicular to plane x. The flange 62 moreover is radially asymmetrical in order to be elongate and to cover an elongated toilet trapway. The enlarged width semi-circles 68, 70 of the flange deflect splashing inward of the toilet during a plunging operation.

Similar to the prior embodiments, a peripheral seal 72 extends from the flange 62 facing away from the bell 60 to seal with the elongated toilet trapway. The seal 72 has a continuous profile extending from the periphery of the flange 62 and consequently is also elongated for mating receipt within the elongated trapway. The seal 72 extends centrally inward. In the depicted embodiment, the seal 72 is radially tapered so that a distal rim 74 of the seal 72 extends into the trapway and the seal 72 engages the trapway with an area contact about the periphery for maintaining a seal during the plunging operation. The seal 72 may also be symmetrical along planes x and y, radially asymmetrical to seal with the elongated toilet trapway.

The plunger 56 has an opening 76 within the rim 74 for revealing a cavity within the plunger 56, for operation similar to the prior embodiments. The plunger 56 may be provided with a plurality of structural ribs 78 for additional structural support.

Figure 9:
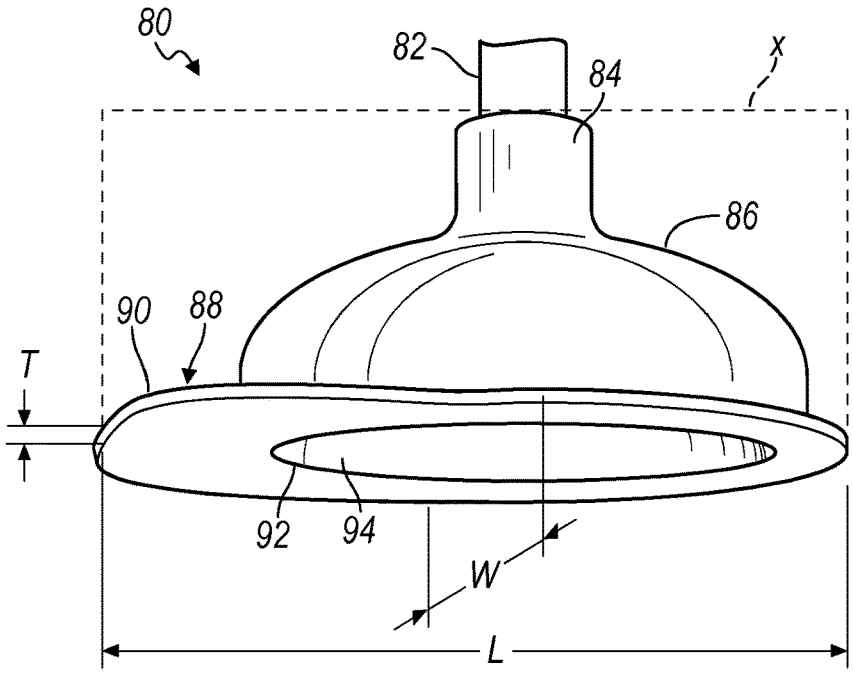
FIG. 9 is a side perspective view of a plunger according to yet another embodiment.
Figure 10:
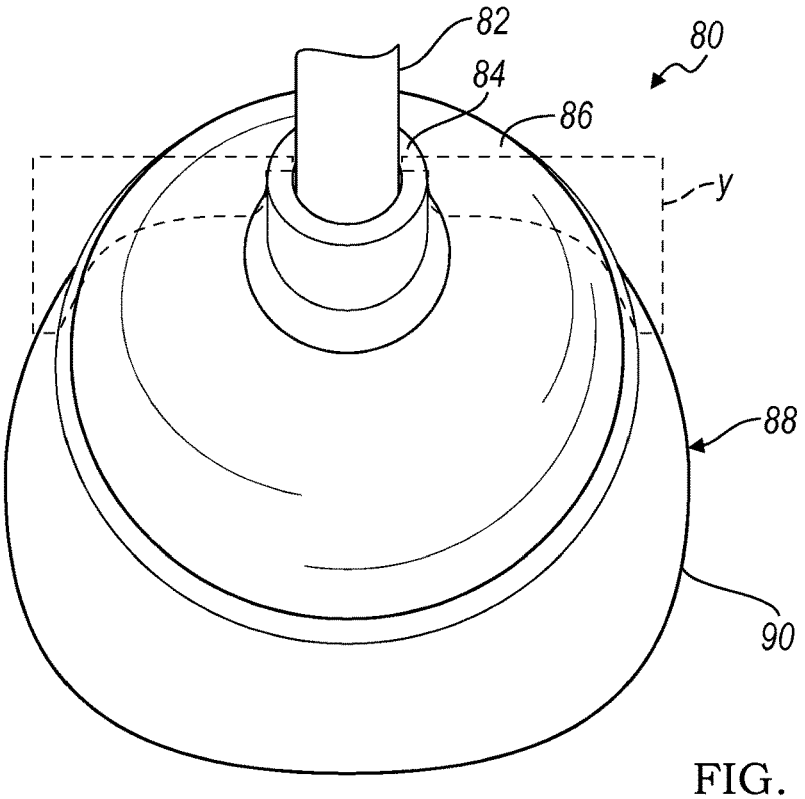
FIG. 10 is a top perspective view of the plunger of FIG. 9.

Referring now to FIGS. 9 and 10, a plunger 80 is illustrated according to another embodiment. The plunger 80 includes a handle 82 received within a threaded receptacle 84 provided atop a bell 86. A flange 88 extends about a periphery of the bell 86. The flange 88 has a length L, a width W and a thickness T; and the length L is greater than the width W to provide an elongated footprint or plan. The depicted flange 88 has a consistent radius about one-half or two quadrants of the bell 86. The flange 88 includes a brim or an enlarged portion 90 about the other half or the other two quadrants of the bell 86.

For manufacturing purposes, the flange 88 may be symmetrical along a central plane x that is generally perpendicular to the flange 88. The flange 88 may also be symmetrical along another central plane y that is also generally perpendicular to the flange 88 and perpendicular to plane x. The flange 88 moreover is radially asymmetrical in order to be elongate and to cover an elongated toilet trapway.

The plunger 80 has an opening 92 within the bell 86 for revealing a cavity 94 within the plunger 80, for operation similar to the prior embodiments. The flange 88 is seated directly upon the toilet bowl about the trapway. Unlike prior embodiments, the bell 86 is not centered relative to the trapway. The plunger 80 requires less material and is easier to manufacture than the prior embodiments. The enlarged portion 90 of the flange 88 also assists deflection of the splashing with the toilet bowl.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A plunger comprising:

a flange having a length, a width and a thickness, wherein the length is greater than the width to cover an elongated toilet trapway; and a peripheral seal extending away from the flange to seal with the elongated toilet trapway;

wherein the seal extends centrally inward from an outward periphery of the flange;

wherein the seal is radially asymmetrical; and wherein the seal has a continuous profile around the periphery of the flange.

2. The plunger of claim 1 wherein the flange is shaped as a pair of semi-circles each having a radius that is half of the width of the flange, the semi-circles being spaced apart in a direction of the length of the flange.

3. The plunger of claim 1 wherein the flange has a pair of parallel sides spaced apart in a direction of the width of the flange.

4. The plunger of claim 1 wherein the seal is tapered inward away from the flange.

5. The plunger of claim 1 further comprising a cylindrical receptacle formed into the flange and spaced apart from the seal for cooperation with a radially symmetrical plunger.

6. The plunger of claim 5 further wherein the receptacle comprises a peripheral ring extending from the flange with an aperture formed therein.

7. The plunger of claim 6 further comprising a plurality of structural ribs, each oriented upon the flange and extending to an intersection of the flange and the peripheral ring.

8. The plunger of claim 1 wherein the seal has an opening therein facing away from the flange.

9. The plunger of claim 8 wherein a cavity is provided within the flange and the seal for fluid communication through the flange, the seal and the seal opening.

10. The plunger of claim 9 further comprising a bell extending from the flange and spaced apart from the seal so that manual compression of the bell forces fluid from the bell, through the flange and the seal.

11. The plunger of claim 10 wherein the bell is formed from an elastomeric material whereby upon release of the manual compression, the bell extends to an unloaded position thereby forcing fluid into the seal opening, through the seal and flange, and into the bell.

12. The plunger of claim 10 wherein the bell is generally dome-shaped.

13. The plunger of claim 10 further comprising a receptacle oriented upon the bell to receive a handle.

14. The plunger of claim 10 further comprising a handle extending from the bell.

15. The plunger of claim 10 further comprising a plurality of structural ribs each oriented upon the flange and extending to an intersection of the flange and the bell.

16. The plunger of claim 10 wherein the seal is tapered inward away from the flange and extends away from the bell prior to a plunging operation.

* * * * *